United States Patent [19]

Walther

[11] Patent Number: 4,461,582

[45] Date of Patent: Jul. 24, 1984

[54] CIRCUIT ARRANGEMENT FOR ADJUSTING A PULSE FREQUENCY OF A QUARTZ-CONTROLLED WATCH OR CLOCK

[75] Inventor: Henry Walther, Wiesbaden-Nordenstadt, Fed. Rep. of Germany

[73] Assignee: VDO Adolf Schindling AG, Frankfurt am Main, Fed. Rep. of Germany

[21] Appl. No.: 410,115

[22] Filed: Aug. 20, 1982

[30] Foreign Application Priority Data

Sep. 5, 1981 [DE] Fed. Rep. of Germany ..... 3135228

[51] Int. Cl.[3] ..... G04B 17/12

[52] U.S. Cl. ..... 368/201; 368/200

[58] Field of Search ..... 368/201, 202, 203

[56] References Cited

U.S. PATENT DOCUMENTS

| | | | |
|---|---|---|---|
| 4,015,419 | 4/1977 | Morokawa et al. | 368/201 |
| 4,101,838 | 7/1978 | Aihara et al. | 368/201 |
| 4,119,726 | 4/1980 | Bykosky et al. | 368/159 |
| 4,247,932 | 1/1981 | Kodama | 368/201 |
| 4,378,167 | 3/1983 | Aizawa | 368/201 |

*Primary Examiner*—Bernard Roskoski

*Attorney, Agent, or Firm*—Martin A. Farber

[57] ABSTRACT

In a circuit arrangement for adjusting a pulse frequency of a quartz-controlled clock or watch there are present a pulse generator, a multi-stage frequency divider arranged behind said pulse generator and in front of a counter, as well as adjustable means for adding clock pulses in front of at least one predeterminable frequency divider stage during a counting cycle, and adjustable means for subtracting a clock pulse between a frequency divider stage of higher frequency and a frequency divider stage of lower frequency in a counting cycle. The higher-frequency frequency divider stages are developed as fixed, pre-settable counters, and between the pre-settable counter and the next following frequency divider stage the adjustable means for subtracting a clock pulse are arranged. In this way the current consumption of the circuit arrangement can be kept small since its elements oscillate only with a relatively low frequency.

6 Claims, 3 Drawing Figures

CIRCUIT ARRANGEMENT FOR ADJUSTING A PULSE FREQUENCY OF A QUARTZ-CONTROLLED WATCH OR CLOCK

The present invention relates to a circuit arrangement for adjusting a pulse frequency of a quartz-controlled clock or watch having a pulse generator, a multi-stage frequency divider arranged behind said pulse generator and in front of a counter, adjustable means for adding clock pulses in front of at least one predeterminable frequency divider stage during a counting cycle and adjustable means for suppressing (subtracting) a clock pulse between a frequency divider stage of higher frequency and a frequency divider stage of lower frequency in a counting cycle.

One such known circuit arrangement comprises a pulse generator having a quartz as oscillating element which gives off, for instance, a frequency of 32,768 Hz. Between this pulse generator and a counter whose output gives off one pulse approximately every 30 seconds there is arranged a multi-stage frequency divider which divides the pulse frequency step-wise to 16,384 Hz, 8,192 Hz, etc. until the counter is fed with a frequency of about 1 Hz. Since the pulse generator does not necessarily oscillate precisely at the frequency of 32,768 Hz for which the circuit arrangement is dimensioned, means for adjusting the pulse frequency are provided, which means, however, do not act directly on the pulse generator. Adjustment of the pulse generator itself, particularly by varying the capacitance of its oscillating circuit by means of a trimmer capacitor, is relatively inaccurate and can reflect back on the voltage given off by the pulse generator and, furthermore, may make the assembly work for the manufacture of an electric clock or watch difficult, and may finally correct the resonant frequency of the quartz only within a limited range. Instead of this, in accordance with the prior art (Swiss Provisional Patent 618 832 G), the adjustable means for adding clock pulses in at least one predeterminable frequency divider stage during a counting cycle, and the adjustable means for suppressing (subtracting) a clock pulse between a higher-frequency frequency divider stage and a lower-frequency frequency divider stage in a counting cycle are provided. In detail the clock pulses are added between a frequency divider stage which has an output pulse of 16,384 Hz and the next frequency divider stage which has an output frequency of 8,192 Hz, in the manner that between the pulses of a frequency of 16,384 Hz further pulses of 16,384 Hz are inserted for a period of time which can be varied in accordance with the adjustment to be effected. These inserted pulses are obtained from an inverted output of the frequency divider stage having the output frequency of 16,384 Hz. For the adding of these pulses during the adjustable period of time a blocking gate arrangement which is fed with the output of the frequency divider stage of 16,384 Hz and its inverted output and furthermore with a pulse of variable length corresponding to the correction to be effected is provided between the frequency divider stage with the output frequency of 16,384 Hz and the frequency divider stage with the output frequency of 8,192 Hz. In order to form the pulse of variable length an SR flip-flop is provided having a first input which, in the same way as an output of this flip-flop, is led to an AND member from whose output the pulse of variable length is taken. The second input of the SR flip-flop can be coupled with one or more of the outputs of the frequency divider stages of 1,024 Hz, 512 Hz, 256 Hz and 128 Hz by the actuation in each case of a trimmer terminal. Since the first input of the SR flip-flop is connected to the output of the counter which gives off one pulse every 30 seconds, i.e. determines the counting cycle, a pulse whose length is dependent on the adjustment of the trimmer terminals is produced during each counting cycle by the SR flip-flop having the AND member behind it. For the subtracting of a pulse, an OR member is arranged between the frequency divider stages of 512 Hz and 256 Hz, it being fed on the one hand with the clock pulses 512 Hz and on the other hand with a pulse formed by an additional flip-flop, with adjustable set input. The set input is acted on by a signal which is formed by the output pulse of the counter which gives off one pulse every 30 seconds, this output pulse of the counter being derived via a flip-flop of the delay type and another SR flip-flop with AND member behind it. The additional flip-flop with the set input produces a pulse of the frequency divider stage which is normally fed with the clock pulse 512 Hz, a relatively long pulse during the period of time in which two pulses at the frequency 512 Hz occur. During these two pulses therefore only one pulse appears at the input of the frequency divider stage which produces a clock frequency of 256 Hz, i.e. the second pulse of the frequency 512 Hz is apparently subtracted.

This known circuit arrangement has the disadvantage that the blocking gate arrangement for the adding of clock pulses must oscillate at a relatively high frequency. If therefore the blocking gate is developed in C-MOS technique, the gate must be switched with high frequencies which, in turn, causes a relatively large consumption of current, a correspondingly high loss of power, and a relatively short life of the battery of the clock.

The object of the present invention, therefore, is to develop the circuit arrangement in such a manner that, with the lowest possible cost of manufacture, there is provided a circuit arrangement with adjustable means for the adding of clock pulses for the adjustment of the pulse frequency the current consumption of which is relatively low since its elements oscillate only with a relatively low frequency.

This object is achieved in accordance with the invention in the manner that the higher-frequency frequency-divider stages are developed as fixed, pre-settable counters (2 to 8) and that the adjustable means (41 to 45) for the suppressing of a clock pulse are arranged between the settable counters and the next following frequency divider stage (9).

Instead of a separate blocking gate arrangement which is developed with high-frequency clock pulses, particularly of a frequency of 16,384 Hz for the insertion of a pulse train of this frequency, frequency divider stages of the multi-stage frequency divider are developed in accordance with the invention, in less expensive manner, as fixed pre-settable counter stages which can be preset to a fixed value. These fixed-pre-settable counter stages are then followed in customary manner by the divider stages and the counters of the clock. In a circuit arrangement having a pulse generator which gives off a pulse frequency of 32,768 Hz, the stages up to the delivery of an output frequency of 256 Hz are preferably developed as counter stages which can be preset to a fixed value. The fixed pre-setting of these counter stages is active once in each counting period of preferably 32 seconds so that during each counting period the pre-set counter stage gives off an additional clock pulse as overflow pulse. Accordingly, the counter stages and the switch elements associated with them are operated with practically the same frequency as when no correction of the pulse frequency is to be effected. Accordingly these switch elements, if they are developed in C-MOS technique, also do not cause a higher current consumption and load the battery of the clock correspondingly less. While in the pre-settable counter stages additional clock pulses are produced corresponding to the fixed pre-setting during each counting cycle, such a clock pulse can be masked out, behind the last pre-settable counter stage in the direction of the signal flow, by the adjustable means for suppressing a clock pulse. The divider stages which adjoin these means for the suppressing of a clock pulse as well as the counter can be of conventional development.

One preferred embodiment of the fixed pre-set counter stages is characterized by the fact that each stage of the pre-settable counter (2 to 8) is developed as toggle flop and that the set input (S) is connected with the output of a NOR member (19 to 25) into the first input of which a constant adjustment signal can be fed and the second input of which can be acted on by a trigger pulse which is produced on the line (26) during each counting cycle. These counter stages can be programmed in simple manner at their set input by the NOR member. By means of the NOR member the connected settable toggle flop is set when an adjustment signal is fed into the NOR member. After the setting of the toggle flop, its output signal is set at high signal as long as the set signal is present. Since the duration of the set signal is less than the duration of the period of the output signal of the oscillator, an additional pulse is added in the toggle flop to the normal output pulse produced by division of the pulse frequency of the pulse generator. This process is repeated upon each counting cycle—with the exception of the first counting cycle, in which the counter stage in question cannot yet be additionally set. Following this, however, the trigger pulse sees to it that at the same time all toggle flops pre-programmed via the NOR members are additionally set as fixed-pre-program counter stages. With this arrangement for the addition of clock pulses a simple line is sufficient for the forwarding of the clock pulses from one counter stage to the next counter stage of the pre-settable counter, i.e. no blocking gates or the like between these stages are necessary.

The edge trigger which produces the trigger pulse may be fed from the counter output of the normal counter with an output signal which determines the counting cycle of ordinarily 32 seconds in the manner that the trigger (35) developed as edge trigger is connected by a first input (A) to an output (18) of the counter (17) connected to the frequency divider (9 to 16), and is coupled by a second input to an output of the last pre-settable counter stage (8) so that a trigger pulse which is short as compared with the counting cycle is produced in each counting cycle. A second input of the edge trigger is connected via a differentiator with the output of the last pre-settable counter stage. In this way the edge trigger produces a trigger pulse which is short as compared with the counting cycle as a function of the occurrence of a differentiated output pulse of the last pre-settable counter stage, for instance of 256 Hz. This trigger pulse effects the additional setting of the counter stages which are pre-set by the programming at the NOR members.

As switch means for programming the counter stages via the associated NOR member (19 to 25) a fusible link connection (28–34) is preferably acted upon by a fixed voltage potential. The fusible link connection is interrupted at the NOR members of the toggle flops, which are to produce an additional clock pulse, after the assembling of the watch when the deviation from the normal is known. Instead of the fusible link connection a cuttable conductor path can also be provided.

The means for subtracting a clock pulse are developed particularly suitably in the manner that the adjustable means for suppressing a clock pulse comprises a flip-flop (41) of the delay type having a set input (S) which is connected to the output of a NOR member (44) and which, in the same way as the NOR members (19 to 25) of the pre-settable counter, can be acted on by a fixed adjustment signal and a trigger pulse, and that one output (Q) of the flip-flop (41) is connected to the following frequency divider stage (9) via a NOR member (42) which furthermore, in the same way as a clock input (C1) of this flip-flop, is connected with the output (Q) of the last pre-settable counter stage (8). The said means comprise a flip-flop with delay properties and a D terminal whose set input can be programmed in the same way as the toggle flops of the pre-settable counter stages and can additionally be set by the trigger pulse. For this purpose the same edge trigger can be used as used for the control of the set inputs of the toggle flops. In this way the cost of manufacture of the circuit arrangement and the energy required for its operation are further reduced.

One preferred embodiment of the invention will be described below with reference to the three figures of the accompanying drawing in which.

Figure 1:
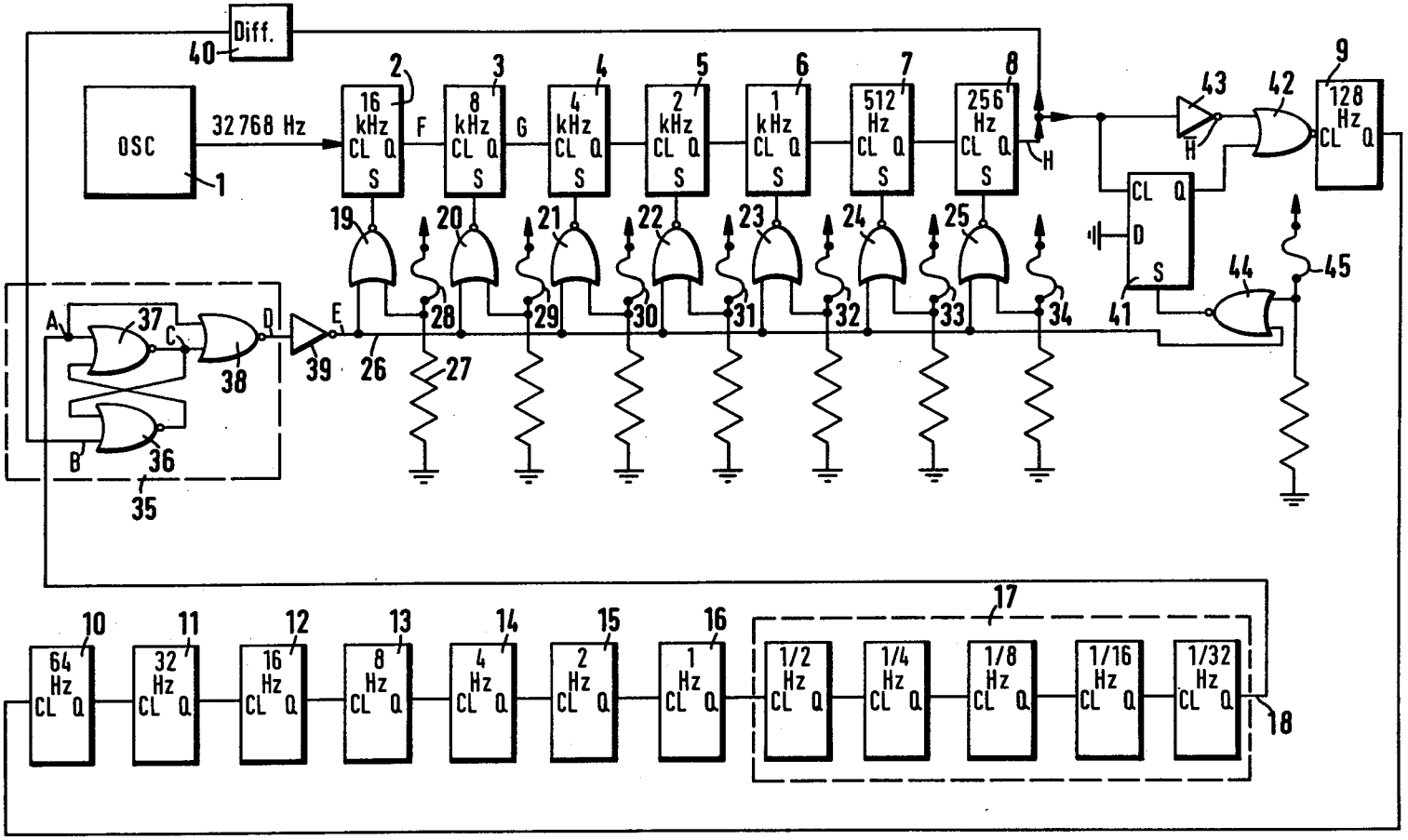
FIG. 1 is a block diagram of the circuit arrangement.

FIG. 1 shows a pulse generator which gives off a pulse frequency of 32,768 Hz. Seven stages of a pre-settable counters, designated 2 to 8, are connected to the pulse generator. In each stage a reduction of the pulse frequency by a factor of 2 takes place, i.e. at stage 8 there is produced an output pulse of the frequency 256 Hz. The counter stage 8 is connected to a multi-stage frequency divider with the divider stages 9 to 16, in each of which the pulse frequency is also halved. The pulse frequency which is given off accordingly at the last divider stage 16 amounts to 1 Hz, which enters into a multi-stage counter 17. From the last stage of the multi-stage counter a signal of the counting cycle of 32 seconds can be taken at the counter output 18.

In order to form the means for the addition of a clock pulse, each pre-settable counter stage is developed with a toggle flop having an input CL fed with the clock pulses and having an output Q and a set input S. The set input S is connected to the outputs of the NOR members 19 to 25 respectively. One input of all the NOR members is connected to a line 26 for trigger pulses. A second input of each NOR member can be connected to positive potential via a fusible link connection 28 which lies close to a grounded resistor, for instance 27.

The line 26 is connected to the output of an edge trigger 35 which is formed of two fed-back NOR members 36 and 37, having the inputs A and B, and of another NOR member 38 which is connected on the one hand to the output of the NOR member 37 and on the other hand to its input A. The output of the NOR member 38 is connected to the line 26 by an invertor member 39. The output of the NOR member 37 is designated C and the output of the NOR member 38 is designated D while the output of the invertor member 39 is designated E. The input A of the edge trigger, formed in this manner, is connected to the counter output 18 of the counter 17. The input B of the NOR member 36, and thus also of the edge trigger, is connected to the output of the pre-settable counter stage 8 via a differentiator 40. Accordingly, the input A is acted on by the output signal, defining the counting cycle, of the last normal counter stage of the counter 17 and the input B is acted on by the differentiated output pulses of the pre-settable counter stage 8 which normally have the frequency of 256 Hz.

As means for subtracting a clock pulse between the pre-settable counter stage 8 and the divider stage 9 there is provided a NOR member 42 which is controllable by a flip-flop 41 of the delay type and is acted on, on the one hand via an invertor stage 43 by the output pulse of the pre-settable counter stage 8 and, on the other hand, by the output Q of the flip-flop 41. The input CL of this flip-flop is in its turn fed by the output of the pre-settable counter stage 8. The terminal D of this flip-flop with delay characteristic is grounded. The set input S can be pre-programmed in the same manner as the set inputs of the pre-settable counter stages 2 to 8 via a NOR member 44 and a fusible link connection 45, and can be set by the trigger pulse on the line 26 to the complement of the normal output signal at the output Q.

The function of the circuit arrangement will be described below with reference to the pulse diagrams of FIGS. 2 and 3.

After the setting up of the circuit arrangement it is determined by how much the pulse frequency of the pulse generator differs from the normal 32,768 Hz and accordingly on which of the pre-settable counter stages 2 to 8 an additional clock pulse is to be formed during each counting cycle or whether a clock pulse is to be subtracted between the counter stage 8 and the divider stage 9 in order accurately to increment the counter 17 of the clock.

Accordingly, after the correction which is to be effected has been established, one or more of the fusible link connections 28 to 34 and 45 is interrupted in order to produce an additional clock pulse during each counting cycle in the corresponding pre-settable counter stage or in order to deduct a clock pulse in front of the divider stage 9.

Figure 2:
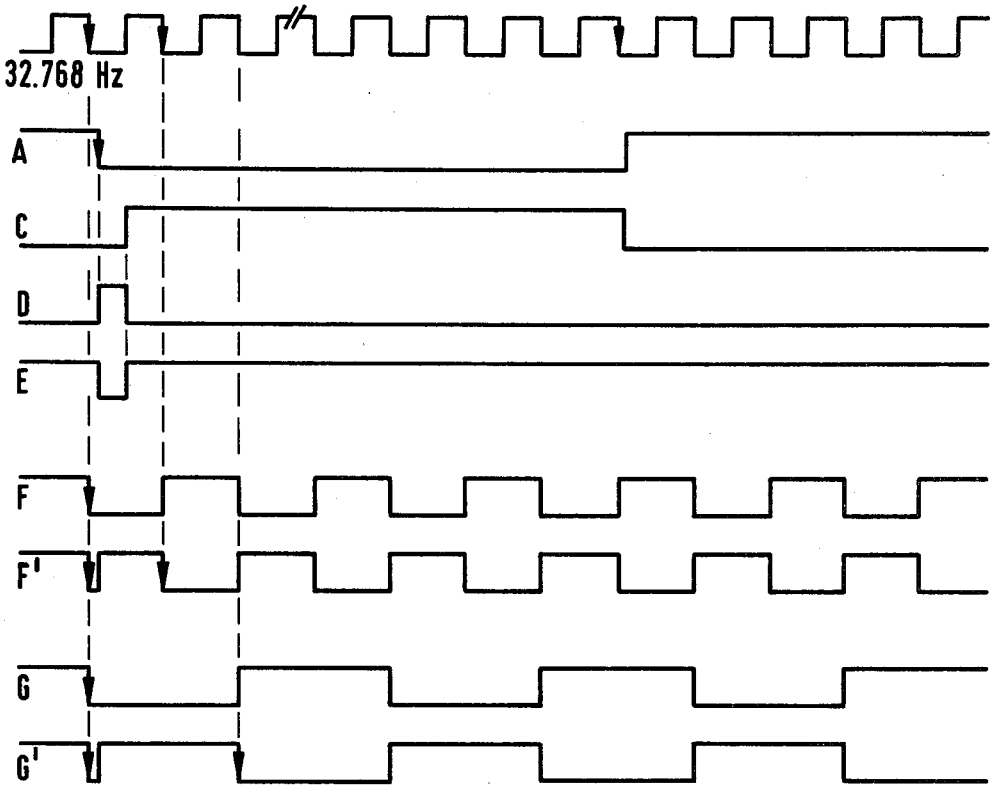
FIG. 2 shows pulse diagrams which indicate the action of the means for the adding of a clock pulse.

From FIG. 2 it can be seen that the pulse frequency of the pulse generator of 32,768 Hz is normally divided in half at the output F of the counter stage 2, namely normally to 16,384 Hz, and that a second division by two takes place at the output G of the unprogrammed counter stage 3 to a value of 8,192 Hz. These processes with halving of the pulse frequency as output frequency at the output of each of the counter stages 2 and 8 and of the divider stages 9 to 16 as well as within the counter 17 take place also in the first counting cycle after the setting of the fusible link connections since the pre-settable counter stages are still not additionally set here.

Upon the formation of the output signal at the counter output 18 at the end of the first counting cycle the signal shown in FIG. 2, line A, appears, however, at the input A of the edge trigger and a signal corresponding to line D is produced at the output D of the edge trigger, said signal being inverted in the invertor member 39 to form the trigger signal-line E. The pre-settable counter stages programmed by the cutting of the fusable link connection, for instance the counter stage 2, are now additionally set by the trigger pulse E. In this way an additional clock pulse is produced after the occurrence of the trigger pulse E; cf. the first two pulse flanks marked with arrows of the pulse train F' in FIG. 2. In similar manner, an additional clock pulse is produced at the output of the counter stage 3 when the fusible link connection 29 is interrupted; cf. line G' as compared with line G which represents the output signal of this counter stage without pre-setting of this and the preceding stages. The pulse at the output of the edge trigger D and thus the trigger pulse E again assume their original potential as a function of the differentiated pulse of the 256 Hz output Q of the pre-settable counter stage 8 since the differentiated pulse enters into the input B of the edge trigger. The trigger pulse E is thus in each case substantially shorter than the pulse of the output signal at the counter output 18 corresponding to the line A. On the other hand, no control processes which take place faster than 256 Hz occur for the addition of a clock pulse.

Figure 3:
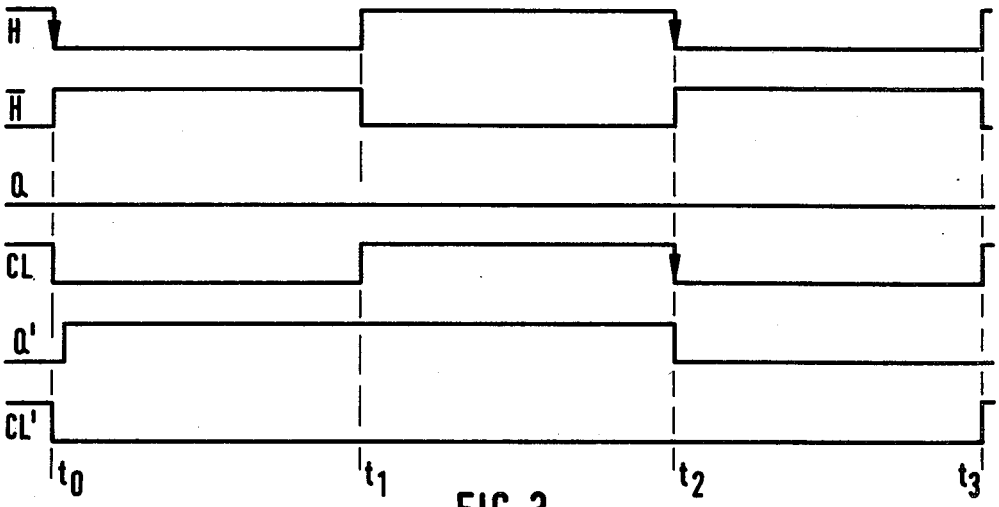
FIG. 3 shows pulse diagrams which indicate the action of the means for subtracting a clock pulse.

The effect of the means for the subtracting of a clock pulse is shown in FIG. 3. Let us first of all assume that the flip-flop 41 is not programmed by disconnection of the fusible connection 45. In such case, the output signal at the output Q of the flip-flop 41 upon control by the clock pulses H retains such a value that the NOR member 42 conducts the inverted clock pulses H—aside from an additional inversion—unchanged as clock pulses C1 at the input of the divider stage 9. If, however, the flip-flop 41, due to disconnection of the fusible link connection 45, is set by the next trigger pulse on the line 26 to its complement, an output pulse Q' is produced thereby, which pulse is terminated by the next negative flank of the clock pulse H and which thus continues so long that the pulse H between $t_1$ and $t_2$ does not act on the input of the divider stage 9; cf. pulse train C1'. Rather, a pulse train C1' appears between $t_0$ and $t_3$ while with unprogrammed flip-flop 41 two pulses C1 occur between $t_0$ and $t_3$. Thus, in practice, there is subtracted one of the clock pulses H which occurs at the start of the counting cycle of 32 seconds, which is furthermore not shown in FIG. 3.

I claim:

1. In a circuit arrangement for adjusting a pulse frequency of a quartz-actuated clock or watch, the circuit arrangement having a pulse generator, a counter, a multi-stage frequency divider having a plurality of frequency-divider stages arranged behind said pulse generator and in front of said counter, adjustable means for adding clock pulses in front of at least one predeterminable stage of said frequency-divider during a counting cycle, and adjustable means for suppressing a clock pulse in a counting cycle between frequency-divider stages of lower frequency of said plurality of stages, the improvement wherein said plurality of frequency divider stages includes a plurality of higher-frequency frequency-divider stages comprising fixed, settable counters and wherein the adjustable means for suppressing a clock pulse is arranged between one of said settable counters and the next following frequency divider stage of said plurality of stages.

2. The improvement as set forth in claim 1, wherein each stage of the pre-settable counters comprises a toggle flop and a NOR member, the set input of the toggle flop being connected with the output of the NOR member, a first input of said NOR member being connected for receipt of a constant adjustment signal and a second input of which NOR member is connected for receipt of a trigger pulse produced during each counting cycle.

3. The improvement as set forth in claim 2, further comprising trigger means for generating trigger pulses, and wherein each of said divider stages comprises a counter, said trigger means being formed as an edge trigger and having a first input and a second input, said trigger means being connected by said first input to an output of one of said counters of a lower frequency stage, said trigger means being coupled by said second input to an output of the lowest-frequency settable counter so that a trigger pulse is produced in each counting cycle, each trigger pulse being short as compared with the counting cycle.

4. The improvement as set forth in claim 2, further comprising a set of fusible link connections, and wherein the first input of a NOR member is connected via a fusible link connection for actuation by a fixed voltage potential.

5. The improvement as set forth in claim 2, further comprising a cuttable conductor path, and wherein the first input of the NOR member is connected via said cuttable conductor path for actuation by a fixed voltage potential.

6. The improvement as set forth in claim 3, wherein the adjustable means for suppressing a clock pulse comprises a first NOR member, a second NOR member, and a flip-flop of the delay type having a set input which is connected to the output of said first NOR member, said first NOR member being in circuit with NOR members of said presettable counter stages for activation by a fixed adjustment signal and a trigger pulse, and wherein one output of the flip-flop is connected via said second NOR member to the frequency divider stage, following said settable counters, a clock input terminal of said flip-flop being connected to an output terminal of the lowest frequency-settable counter stage.

* * * * *